US007429149B2

(12) United States Patent
Price et al.

(10) Patent No.: US 7,429,149 B2
(45) Date of Patent: Sep. 30, 2008

(54) SLEEVED SEGMENTED FOUNDATION SUPPORT PRODUCT

(76) Inventors: Matt Price, 14102 W. 87th Ter., Lenexa, KS (US) 66215; Richard Wayne Garoutte, 5212 S. 42nd St., Rogers, AR (US) 72758

( * ) Notice: Subject to any disclaimer, the term of this patent is extended or adjusted under 35 U.S.C. 154(b) by 0 days.

(21) Appl. No.: 11/457,547

(22) Filed: Jul. 14, 2006

(65) Prior Publication Data

US 2008/0014027 A1 Jan. 17, 2008

(51) Int. Cl.
*E02D 5/30* (2006.01)

(52) U.S. Cl. ..... 405/257; 405/252

(58) Field of Classification Search ..... 405/230–232, 405/250–252, 256–257
See application file for complete search history.

(56) References Cited

U.S. PATENT DOCUMENTS 2,983,104 A 5/1961 Bruns
3,963,056 A 6/1976 Shibuya et al.
5,228,807 A 7/1993 Willcox, Jr.
5,288,175 A 2/1994 Knight
5,713,701 A 2/1998 Marshall
6,609,856 B1 8/2003 Knight
6,799,924 B1 10/2004 Kight et al.
6,848,864 B1 2/2005 Davie, Jr. et al.
6,881,012 B2 4/2005 Covington
6,951,437 B2 10/2005 Hall
2005/0111920 A1 5/2005 Kight et al.
2006/0067794 A1 3/2006 Mitchell

*Primary Examiner*—Sunil Singh

(57) ABSTRACT

The invention is a sleeved, segmented support product for supporting a foundation, for example a building foundation. The product comprises support segments that can assemble together into a variable-length pile. The segments assemble together telescopically so that adjacent segments are held in coaxial relation and resist radial misalignment and other misalignments that can reduce a load-bearing capacity of the support product.

14 Claims, 5 Drawing Sheets

SLEEVED SEGMENTED FOUNDATION SUPPORT PRODUCT

The invention is a segmented support product for supporting a foundation, for example a building foundation. The product comprises support segments that can assemble together into a variable-length pile. The segments assemble together telescopically so that adjacent segments are held in coaxial relation and resist radial misalignment and other misalignments that can reduce a load-bearing capacity of the support product.

Each segment has an outer sleeve surrounding an inner plug. The outer sleeve extends beyond the plug at one end of the segment and forms a cavity. The plug extends beyond the sleeve at the opposite end of the segment and forms a projection. The segments are assembled together by inserting telescopically a plug projection into a cavity. A close fit between the projection and the cavity maintains the assembled segments in coaxial alignment and resists radial movement between the segments. When assembled, the segment plugs abut to form an elongate, segmented pile capable of significant compressive load-bearing, for example bearing the load from the supported foundation. Additional segments can be assembled together to form a variable-length pile.

Since each segment is relatively small, minimal excavation underneath the foundation is necessary in order to install the product. The product can be installed by pushing a segment into the ground underneath the foundation; assembling another segment with the initial segment; and then pushing both segments further into the ground. Additional segments can be assembled sequentially and the resulting segmented pile can be pushed further into the ground until the required support is attained. After installing, any space between the segmented pile and the foundation is blocked and shimmed so that the product supports the foundation.

The outer sleeve surrounding each plug provides significant additional strength to the segment and improves the segment resistance to compressive failure when the segment is compressed by the foundation.

Additionally, the sleeve covers abutting faces of the assembled segments and inhibits soil and other contaminants from intruding between the abutting faces.

DRAWINGS

Foundations for buildings and other structures are often supported by elongate column-like elements called piles. Piles are typically driven into the ground underneath a foundation so that the foundation rests on top of the pile.

Figure 1:
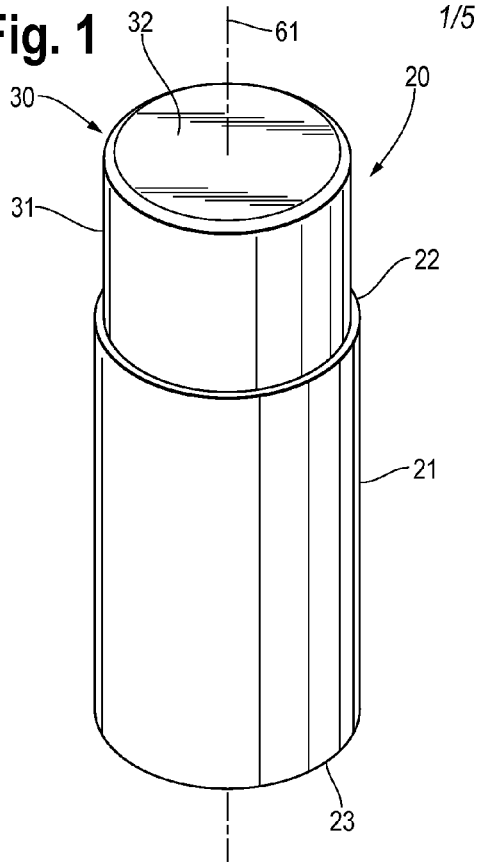
FIG. 1 is a perspective view of an embodiment of a support segment.

Piles can have unitary, continuous configurations, for example wooden piles and conventional pre-stressed concrete piles. Alternatively, piles can be constructed of individual segments that are stacked together to create a column-like assembly of segments.

Both unitary and segmented piles can provide significant support when compressed between the ground and the foundation. Piles are strongest when they are straight, so that the compressive load is distributed equally through the pile.

Segmented piles, in particular, are vulnerable to failure when some segments are misaligned with respect to each other.

Ground shifting due to rain and other conditions can cause the ground around the segmented pile to shift position. Ground shifting can bias a segment to move out of alignment with adjacent segments, which can significantly reduce a load-bearing capacity of the segmented pile.

The sleeved, segmented support product utilizes a unique approach to forming a segmented pile. When assembled, the support product resists misalignment between adjacent segments that can reduce compressive load-bearing capacity of the segmented pile.

Also, the product has segments that each possesses increased load-bearing capacity due to an outer sleeve surrounding an inner plug. The inner plug supports most of the compressive load applied by the foundation. The outer sleeve confines the plug and inhibits plug deformation that can cause plug fracturing and other plug failures. When assembled, the support product has greater compressive load-bearing capacity than other similar-sized segmented piles.

The sleeved, segmented support product comprises at least a first segment and a second segment. The first segment and the second segment are functionally interchangeable.

Each segment has a cylindrical, tubular outer sleeve. The sleeve has a cylinder axis, a front opening, and a rear opening. The sleeve can be metal, plastic and various other materials.

Each segment further comprises a substantially cylindrical plug. The plug is coaxially aligned with the sleeve.

The plug extends axially from an interior plug face within the sleeve to an exterior plug face beyond the sleeve. The interior plug face and the exterior plug face are both transverse to the cylinder axis.

The interior plug face is positioned within the sleeve between the front opening and the rear opening and the plug substantially fills the sleeve between the front opening and the interior plug face.

The outer sleeve and the interior plug face form a cavity between the interior plug face and the rear opening.

The exterior plug face is positioned beyond the sleeve distal the front opening so that the front opening is between the exterior face and the rear opening. The plug forms a projection between the sleeve front opening and the exterior plug face.

The plug is bonded securely to the sleeve. The plug can be various materials, such as concrete, epoxy, plastic, and other materials so long as they provide sufficient strength and rigidity to support the compressive load applied by the foundation.

The plug can be bonded to the sleeve by being cast integrally within the sleeve. Alternatively, the plug can be formed separately from the sleeve and then bonded securely within the sleeve.

In FIG. 1, the first segment 20 has a sleeve 21. The sleeve 21 is a right circular cylinder. Alternatively, the sleeve can be other types of cylinders, for example, elliptical, curvilinear, rectangular, and polygonal cylinders.

The sleeve 21 has a cylinder axis 61, a front opening 22, and a rear opening 23.

The first segment 20 has a cylindrical plug 30 with a transverse exterior plug face 32 and a transverse interior plug face 33. The plug is coaxially aligned with the sleeve.

Figure 2:
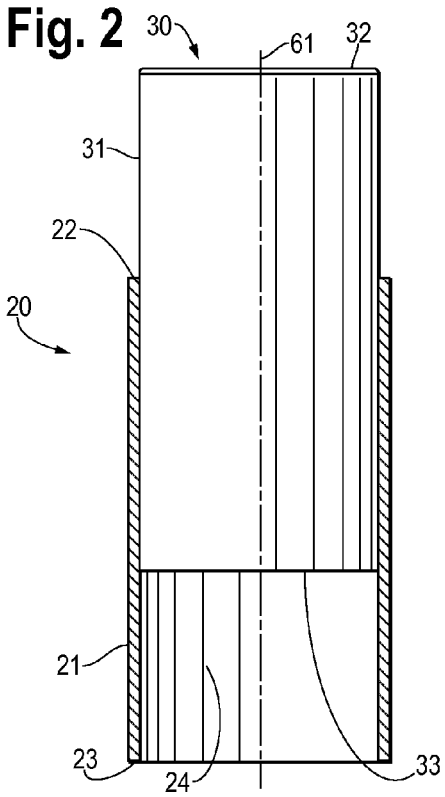
FIG. 2 is a side section view of an embodiment of a support segment.

As shown in FIG. 2, the plug 30 fills the sleeve between the front opening 22 and the interior plug face 33. The plug 30 and the sleeve 21 form a cavity 24 between the interior face 33 and the rear opening 23.

The plug extends outwards from the front opening 22 to the exterior plug face 32 and forms a plug projection 31.

The projection and cavity are utilized to assemble segments together. A projection, for example the projection of the first segment, is inserted telescopically into a cavity, for example the cavity of a second segment.

When segments are assembled, the segment plugs contact each other so that the compressive load from the foundation is substantially distributed through the plugs of the assembled segments.

Figure 3:
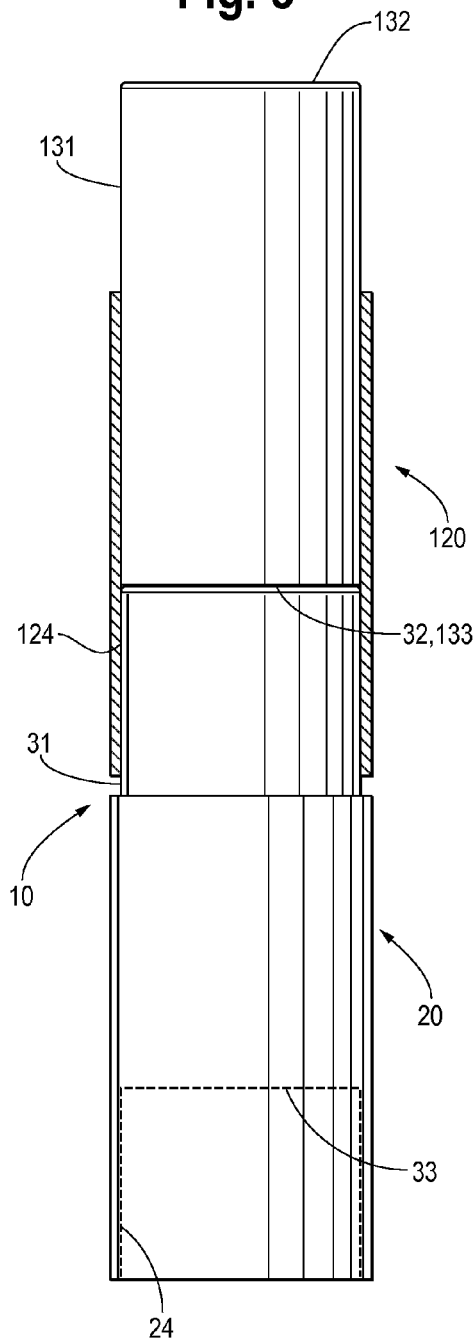
FIG. 3 is a side section view of an embodiment of the support product.

As shown in FIG. 3, the support product 10 comprises the first segment 20 and a second segment 120. The first segment plug projection 31 is inserted telescopically into a second segment cavity 124. The first segment exterior plug face 32 contacts a second segment interior plug face 133.

"Telescopically", as used here and throughout, means the projection and the cavity insert one within another and fit together so that they cannot substantially move radially with respect to each other.

The projection and cavity assembly enables the support product to accommodate ground shifting and other conditions without sustaining potentially damaging misalignment. Ground shifting is a common occurrence under some soil conditions. For example, the soil can swell due to rain and other causes. When the soil swells the foundation can lift off of piles, allowing conventional segmented piles to separate and become misaligned. When soil conditions revert and the foundation resettles, the misaligned segments can come together skewed, which can result in concentrated loading and other conditions leading to pile failure.

Telescopically inserting the projection into the cavity enables the assembled segments to maintain coaxial alignment even if shifting ground conditions cause the segments to move axially with respect to each other. In addition, telescopically inserting the projection into the cavity holds the adjacent plug faces in parallel alignment so that the compressive load is distributed substantially equally throughout the segment plugs.

The projection penetrates the cavity to a cavity depth substantially equal to the distance between the interior plug face and the sleeve rear opening. The assembled segments can move axially within the cavity depth before the segments separate and can move radially with respect to each other. Greater cavity depth provides greater resistance to misalignment.

The projection is cylindrical and has a cylinder cross-section that is transverse to the cylinder axis. The cross-section has a major linear cross-section dimension that is equal to the largest straight-line measurement across the cross-section. For example, a rectangular cylinder has a rectangular cross-section. The rectangular cross-section has a major linear cross-section dimension equal to a distance between opposite corners. Alternatively, a circular cylinder has a circular cross-section. The circular cross-section has a major linear cross-section dimension equal to a diameter of the circular cross-section. Alternatively, a triangular cylinder has a triangular cross-section. The triangular cross-section has a major linear cross-section dimension equal to a length of a longest triangle leg.

Figure 4:
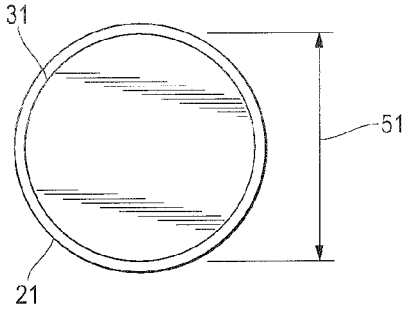
FIG. 4 is a view of an embodiment of a support segment.

In FIG. 4, the major linear cross-section dimension 51 for the first segment projection 31 is shown. The projection 31 is a circular cylinder and the major linear cross-section dimension 51 is the diameter of the circular cylinder.

It has been found to be useful for the cavity depth to be at least one fourth of the major linear cross-section dimension in order to provide effective resistance against segment misalignment. Useful results have been achieved using segments with cavity depths around 0.8 times the projection cylinder major linear cross-section dimension.

Telescopically inserting the projection into the cavity ensures that only a small annular gap exists between the projection and the sleeve. The gap provides a minimal path for soil intrusion between the contacting plug faces. Soil and other contaminants that penetrate the annular gap have to travel from the sleeve rear opening to the end of the plug in order to intrude between the contacting plugs, minimizing the likelihood of soil intrusion between the plugs.

A small amount of soil and other contaminants that may reach the contacting plug faces will likely distribute into small crevices and discontinuities in the plug faces and have minimal deleterious effects on the load-bearing capacity of the support product.

Furthermore, soil that penetrates the annular gap further impedes the path for subsequent soil and other contaminants. Shortly after initial installation in the ground, any path to the contacting faces will be effectively blocked by initial soil intrusion into the annular gap.

Some embodiments can utilize tar, caulk, and other barriers to prevent soil intrusion and segment separation after installation. For example, the cavity and the projection can be coated with viscous material prior to assembly. After assembly the viscous material can substantially fill any gaps between the sleeve, the projection and the plug faces.

Alternatively, various adhesives can be applied to the cavity and the projection so that assembled segments are bonded together.

Alternatively, various combinations of barriers and adhesives can be utilized to prevent soil and contaminant intrusion and to bond assembled segments together.

Various mechanical connectors can be utilized, in addition to the projection and cavity, to connect assembled segments together. For example, threaded connectors, hook and eye connectors, pawls, and various other connectors and combinations thereof can be utilized to connect assembled segments together.

A support segment can have a reinforcing member positioned within the plug and cast integrally into the plug. Reinforcing members are well known in the art and are commonly utilized to strengthen cast structures, for example cast concrete piles and various other cast structures.

Figure 5:
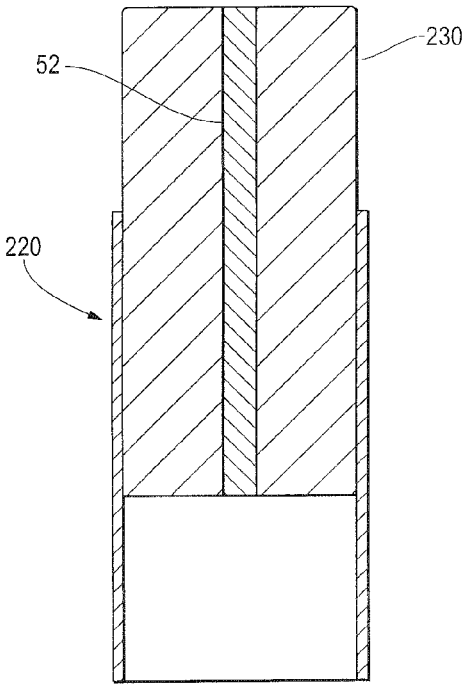
FIG. 5 is a side section view of an embodiment of a support segment.

As shown in FIG. 5, the first segment 220 has a reinforcing bar 52 positioned axially within the plug 230.

A support segment can have a passage extending axially through the plug. It can be useful to extend a filament, such as a rope and a cable, through the passage of a first segment and to anchor the filament to the first segment. When a second segment and additional segments are subsequently assembled together and pushed into the ground, the filament can be extended through the passage of each segment so that the filament extends through the resulting segmented pile.

The filament, in use, can provide additional stability and resistance to misalignment to the segmented pile. Alternatively, the filament can indicate penetration depth into the ground. Alternatively, the filament can be tensioned to impart pre-loading compression upon the segmented pile.

Figure 6:
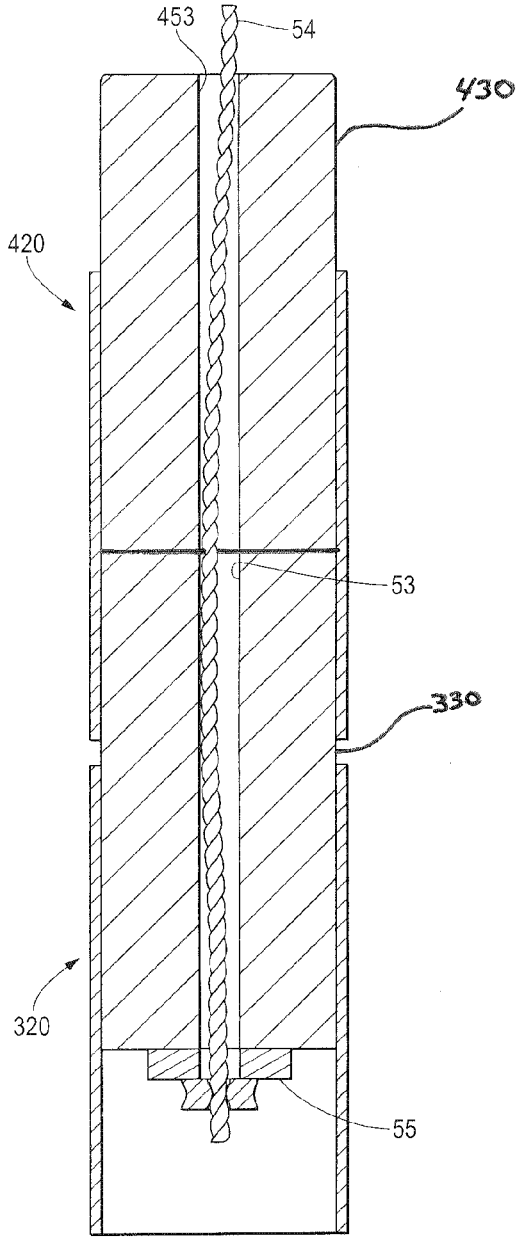
FIG. 6 is a side section view of an embodiment of the support product.

In FIG. 6, the first segment 320 has a passage 53 through the plug 330. The second segment 420 has a passage 453 through the plug 430. The filament 54 is anchored to the segment 320 via the anchor plate 55 and the filament 54 passes through the first segment 320 and the second segment 420. The filament can pass through any subsequent segments assembled to form a segmented pile.

Support segments can have various sizes. Segment overall lengths, that is, the axial distance between the sleeve rear opening and the projection exterior face, can range from less than 4 inches to more than 16 inches depending on existing soil, foundation, and various other relevant conditions. Good results have been achieved with segments having overall lengths around 8 inches.

Similarly, the segments can have various major linear cross-section dimensions. For example, major linear cross-section dimensions can range from less than 2 inches to more than 16 inches depending on existing soil, foundation, and various other relevant conditions. Good results have been achieved with segments having major linear cross-section dimensions around 3 inches.

The support product can be installed beneath an existing foundation. Because each segment is small, the product can be installed by excavating an installation space beneath the foundation that is sufficiently large enough to position a first segment under the foundation and to position a pushing device between the segment and the foundation.

The pushing device can be any device that pushes the first segment away from the foundation and into the ground. The pushing device can include, but is not limited to, a jack, such as a hydraulic, pneumatic, scissors and various other jacks.

The pushing device can push the first segment into the ground underneath the foundation. Then a second segment can be assembled together with the first segment to form a segmented pile. The pushing device can push the assembled segments into the ground underneath the foundation. An additional segment can be assembled together with the second segment to lengthen the segmented pile and the pushing device can push the first, second, and additional segment into the ground underneath the foundation.

More segments can be assembled together with the previously installed segments and the pushing device can push each segment into the ground along with the previously installed segments until the ground resists the pushing device sufficiently to provide support to the foundation.

When enough segments are installed to provide sufficient support, the pushing device can be removed. The remaining space between the installed segments and the foundation can be blocked with one or more substantially rigid objects, such as masonry cap blocks, pipe columns, fabricated spacers, and various other rigid objects. Any remaining space can be shimmed so that the installed segments support the foundation.

In some installations it can be useful to attach a cap to the last installed segment. The cap can provide a platform for the objects used to block between the installed segments and the foundation. Also, the cap can provide a secure connection to the segments and can prevent misalignment between the objects, the foundation and the segments.

Figure 7:
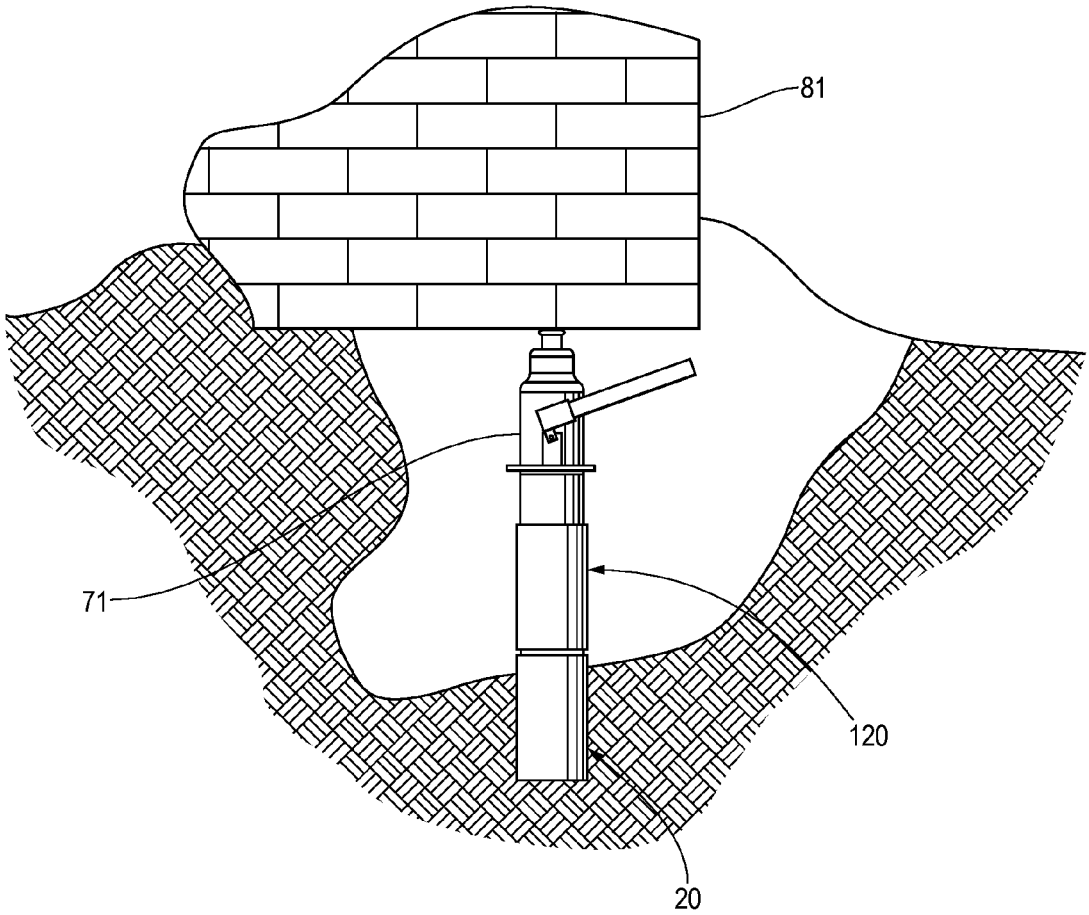
FIG. 7 is a side view of an embodiment of the support product being installed underneath a foundation.

In FIG. 7, the support product is shown during installation beneath a foundation 81. The first segment 20 has been pushed into the ground. The second segment 120 is assembled together with the first segment 20 and a hydraulic jack 71 is positioned between the second segment 120 and the foundation 81. The jack 71 can push against the foundation 81 and push the first segment 20 and the second segment 120 into the ground underneath the foundation.

The support product in FIG. 7 is shown with the first segment 20 being pushed into the ground cavity first. The support product can be installed cavity first and can be installed projection first. Both cavity first and projection first installations are within the scope of the invention and can be selected based on soil conditions, foundation conditions, and various other conditions.

The first segment can have a starter attached prior to pushing the first segment into the ground. The starter can be shaped to facilitate pushing the segment into the ground by piercing the ground, by directing the segment into the ground, and by breaking up hard soil. For example, the starter can be conically-shaped with a pointed end preceding the first segment into the ground. The pointed end eases entry into the ground by piercing the surrounding ground and guides the segments in the direction of the point. Starters can have various shapes and configurations and can be various materials.

Figure 8:
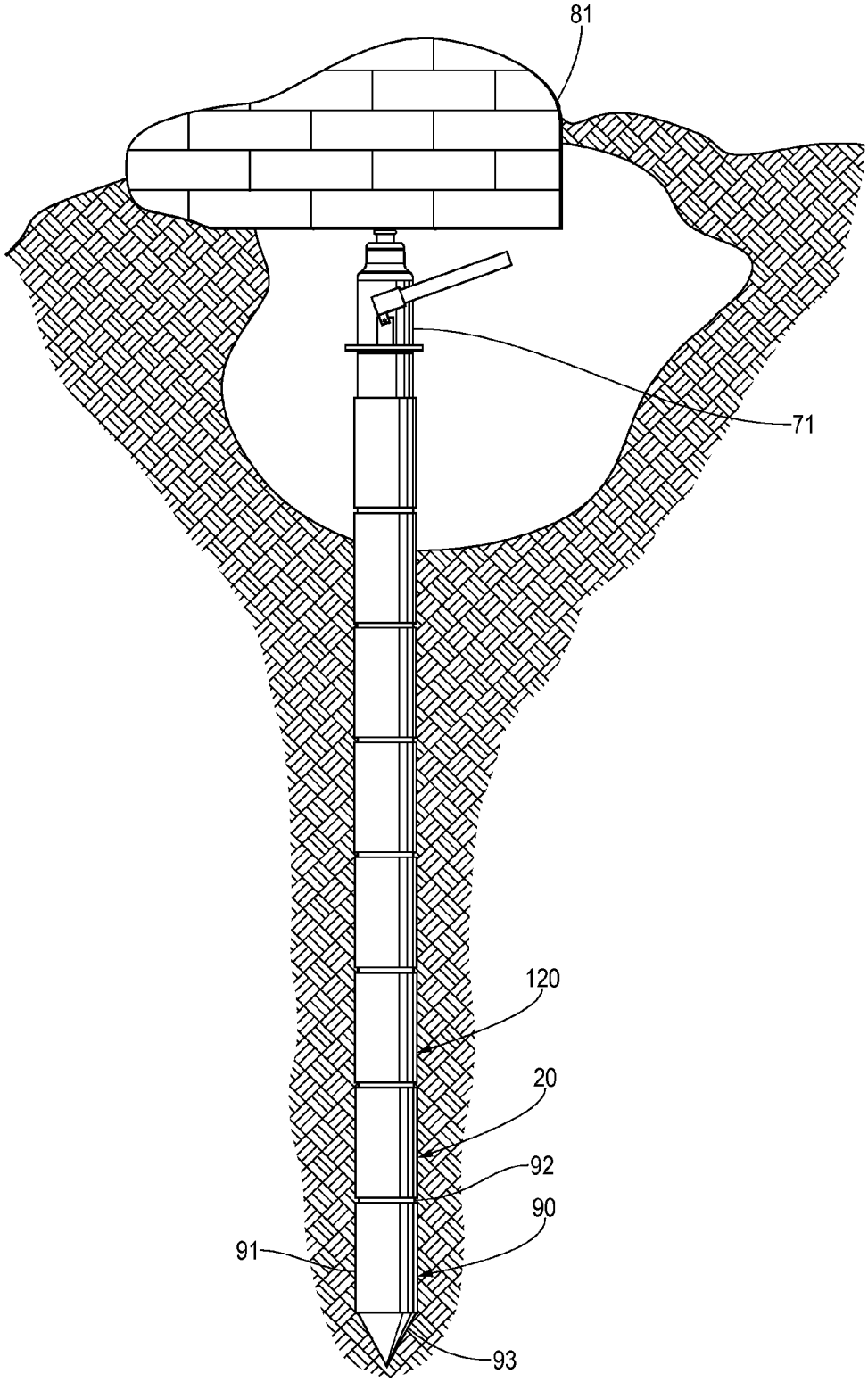
FIG. 8 is a side view of an embodiment of the support product being installed underneath a foundation.

In FIG. 8, the support product is shown during installation beneath a foundation 81. The first segment 20 with a starter 90 attached has been pushed into the ground. The starter 90 has an outer sleeve 91. The starter 90 has a starter projection 92 that is sized to insert telescopically into a segment cavity. The starter 90 has a conical point 93 extending beyond the sleeve 91 opposite the projection 92.

The second segment 120 is assembled together with the first segment 20. Additional segments have been sequentially assembled and pushed into the ground by the hydraulic jack 71 to form an elongate, segmented pile underneath the foundation 81.

Figure 9:
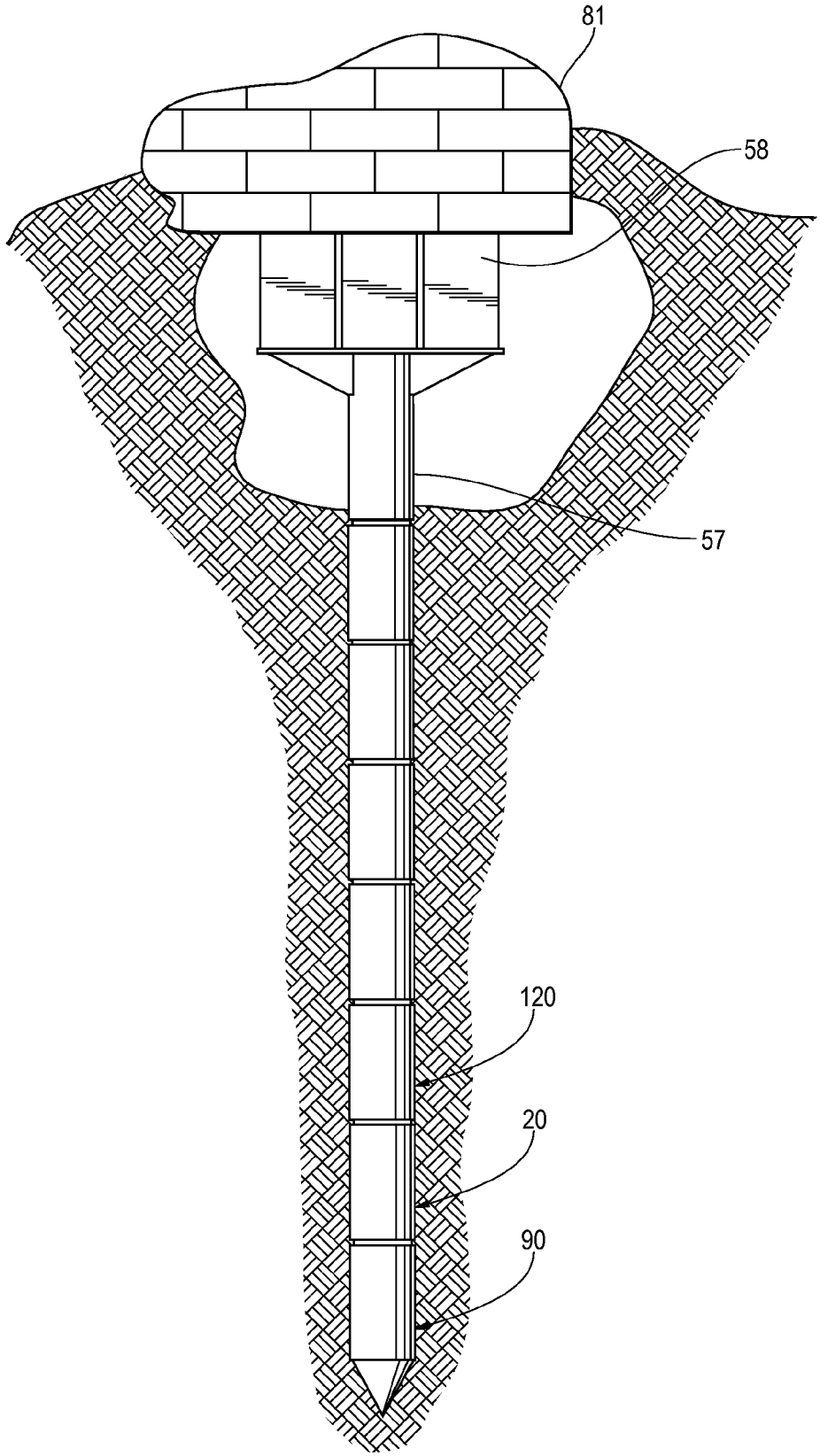
FIG. 9 is a side view of an embodiment of the support product being installed underneath a foundation.

In FIG. 9, the jack has been removed and a cap 57 has been positioned on top of the installed segments. The remaining space between the installed segments and the foundation 81 has been blocked by cap blocks, such as the cap block 58, so that the installed segments support the foundation 81.

After installing the support product underneath the foundation, and blocking between the support segments and the foundation, the installation space can be filled with soil, aggregate, and various other materials.

The invention claimed is:

1. A segmented foundation support product comprising:

a first support segment and a second support segment, each segment comprising:

a cylindrical, tubular sleeve, the sleeve having a cylinder axis, a front opening, and a rear opening;

a non-metal substantially cylindrical plug, the plug being coaxial to the cylinder axis;

the plug extending axially from a transverse interior plug face within the sleeve to a transverse exterior plug face beyond the sleeve;

the interior plug face being positioned inside the sleeve medial the front opening and the rear opening;

the exterior plug face being positioned outside the sleeve distal the front opening;

the plug substantially filling the sleeve between the interior plug face and the front opening;

the plug forming a plug projection between the front opening and the exterior plug face;

the plug and the sleeve forming a cavity within the sleeve between the interior plug face and the rear opening;

the plug being bonded securely to the sleeve;

the segments, in use, being assembled together with a plug projection inserted telescopically into a cavity so that the first segment plug contacts the second segment plug and so that the first segment sleeve is wholly spaced apart from the second segment sleeve; and the projection and the cavity fitting together so that the assembled segments cannot substantially move radially with respect to each other.

2. The product of claim 1 wherein the plug is integrally cast into the sleeve.

3. The product of claim 1 wherein the projection has a major linear cross-section dimension; and wherein the projection extends into the cavity at least a distance equal to one fourth the major linear cross-section dimension.

4. The product of claim 1 wherein the projection is a substantially circular cylinder with a cylinder diameter, and wherein the projection extends into the cavity at least a distance equal to one fourth the cylinder diameter.

5. The product of claim 1 wherein each segment further comprises:

a reinforcing member positioned within the plug and integrally cast into the plug.

6. The product of claim 1 wherein each segment further comprises:

a passage extending axially throughout the plug;

and wherein the product further comprises:

a filament anchored to a segment;

the filament extending through a passage of the first segment and through a passage of the second segment.

7. A segmented foundation support product comprising:

a first support segment and a second support segment, each segment comprising:

a circular, cylindrical, tubular, sleeve, the sleeve having a cylinder axis, a front opening, and a rear opening;

a non-metal substantially circular cylindrical plug, the plug being coaxial to the cylinder axis;

the plug extending axially from a transverse interior plug face within the sleeve to a transverse exterior plug face beyond the sleeve;

the interior plug face within the sleeve being at least 1.5 inches from the rear opening;

the exterior plug face beyond the sleeve being at least 1.5 inches from the front opening;

the plug substantially filling the sleeve between the interior plug face and the front opening;

the plug forming a plug projection between the front opening and the exterior plug face;

the plug and the sleeve forming a cavity within the sleeve between the interior plug face and the rear opening;

the plug being bonded securely to the sleeve; and the segments, in use, being assembled together with a plug projection inserted telescopically into a cavity so that the first segment plug contacts the second segment plug and so that the first segment sleeve is wholly spaced apart from the second segment sleeve; and the projection and the cavity fitting together so that the assembled segments cannot substantially move radially with respect to each other.

8. The support product of claim 7 wherein the plug is integrally cast within the sleeve.

9. The support product of claim 7 wherein the circular, cylindrical, tubular sleeve further comprises:

an inside diameter;

and wherein the plug further comprises:

a plug projection diameter sufficient to provide a close, sliding fit between the projection and the sleeve inside diameter.

10. The support product of claim 9 wherein the sleeve inside diameter measures between 2.5 inches and 4 inches.

11. A method of supporting a foundation comprising:

providing a first support segment and a second support segment, each segment comprising:

a cylindrical, tubular sleeve, the sleeve having a cylinder axis, a front opening, and a rear opening;

a non-metal substantially cylindrical plug, the plug being coaxial to the cylinder axis;

the plug extending axially from a transverse interior plug face within the sleeve to a transverse exterior plug face beyond the sleeve;

the interior plug face being positioned inside the sleeve medial the front opening and the rear opening;

the exterior plug face being positioned outside the sleeve distal the front opening;

the plug substantially filling the sleeve between the interior plug face and the front opening;

the plug forming a plug projection between the front opening and the exterior plug face;

the plug and the sleeve forming a cavity within the sleeve between the interior plug face and the rear opening;

the plug being bonded securely to the sleeve;

the segments, in use, being assembled together with a plug projection inserted telescopically into a cavity so that the first segment plug contacts the second segment plug and so that the first segment sleeve is wholly spaced apart from the second segment sleeve; and the projection and the cavity fitting together so that the assembled segments cannot substantially move radially with respect to each other;

pushing the first segment into the ground underneath the foundation;

assembling the first segment and the second segment together by inserting a plug projection telescopically into a cavity so that the first segment plug contacts the second segment plug;

pushing the assembled segments further into the ground;

blocking between the segments and the foundation so that the segments support the foundation.

12. The method of claim 11 wherein prior to pushing the first segment into the ground, a starter is attached to the first segment so that the starter precedes the first segment into the ground.

13. The method of claim 11 wherein prior to blocking between the segments and the foundation, a cap is positioned on top of the segments.

14. A method of supporting a foundation comprising the steps of:

providing a plurality of support segments, each segment from the plurality of support segments being functionally interchangeable;

each segment from the plurality of support segments comprising:

a cylindrical, tubular sleeve, the sleeve having a cylinder axis, a front opening, and a rear opening;

a non-metal substantially cylindrical plug, the plug being coaxial to the cylinder axis;

the plug extending axially from a transverse interior plug face within the sleeve to a transverse exterior plug face beyond the sleeve;

the interior plug face being positioned inside the sleeve medial the front opening and the rear opening;

the exterior plug face being positioned outside the sleeve distal the front opening;

the plug substantially filling the sleeve between the interior plug face and the front opening;

the plug forming a plug projection between the front opening and the exterior plug face;

the plug and the sleeve forming a cavity within the sleeve between the interior plug face and the rear opening;

the plug being bonded securely to the sleeve; and the segments, in use, being assembled together with a plug projection inserted telescopically into a cavity so that the plugs contact and so that the first segment sleeve is wholly spaced apart from the second segment sleeve; and the projection and the cavity fitting together so that the assembled segments cannot substantially move radially with respect to each other;

pushing a first segment from the plurality of support segments into the ground directly underneath the foundation;

assembling the first segment and a second segment together to form a segmented pile by inserting a plug projection telescopically into a cavity so that the first segment plug contacts the second segment plug;

pushing the segmented pile into the ground directly underneath the foundation;

sequentially assembling another segment from the plurality of segments to the segmented pile and pushing the segmented pile further into the ground until the segmented pile attains a desired depth into the ground underneath the foundation;

positioning a cap on the segmented pile between the pile and the foundation;

blocking between the cap and the foundation so that the segmented pile supports the foundation.

* * * * *